United States Patent [19]

Fortier

[11] 4,382,617

[45] May 10, 1983

[54] COMBINED BOOK LEAF HOLDER AND BOOKMARK

[76] Inventor: J. Paul Fortier, 6220 Dartmouth Ave. North, St. Petersburg, Fla. 33710

[21] Appl. No.: 196,218

[22] Filed: Oct. 14, 1980

[51] Int. Cl.[3] ..... B42D 9/00

[52] U.S. Cl. ..... 281/42; 24/261 C

[58] Field of Search ..... 281/42, 43, 44, 45; 24/261 R, 67, 261 C, 81, 153

[56] References Cited

U.S. PATENT DOCUMENTS

| | | | |
|---|---|---|---|
| 294,087 | 2/1884 | Small | 281/42 X |
| 395,473 | 1/1889 | Bartley | 281/42 X |
| 840,475 | 1/1907 | Conter | 281/42 X |
| 1,150,678 | 8/1915 | Heazlewood . | |
| 1,196,715 | 8/1916 | Noll | 281/45 |
| 1,469,163 | 9/1923 | Mallina | 281/42 |
| 1,646,291 | 10/1927 | Horacek . | |
| 1,710,949 | 4/1929 | Pokora . | |
| 2,271,807 | 2/1942 | Shaughnessy . | |
| 3,661,405 | 5/1972 | Brown | 281/42 |

*Primary Examiner*—Paul A. Bell

*Attorney, Agent, or Firm*—Walter J. Kreske

[57] ABSTRACT

A combined book leaf holder and bookmark (10) for both paper back and hard cover books comprised of a pair of substantially parallel prongs (12 & 14) for insertion of one of the prongs (12) behind the spine of the book and the other prong (14) between the leaves several pages beyond the pages of immediate interest, each of the prongs (12 & 14) being in the form of two wire legs (16, 18 & 22,20) with one of the legs of each of the prongs (16 & 20) emanating from a common juncture (24) and the other leg of each of the prongs (18 & 22) emanating from a reverse bend (26 & 28) at the extremity of the prong, each of the other legs (18 & 22) having a wire arm (34 & 36) extending outwardly at substantially right angles to the prongs (12 & 14), the respective arms (34 & 36) being in substantially a single plane with the prongs (12 & 14) and extending in opposite directions from each other, and each of the arms (34 & 36) having a finger (42 & 44) transverse to the associated arm (34 & 36) for engaging a page of the book on respective sides of the spine to hold the book open at the engaged pages.

9 Claims, 8 Drawing Figures

Fig. 1.
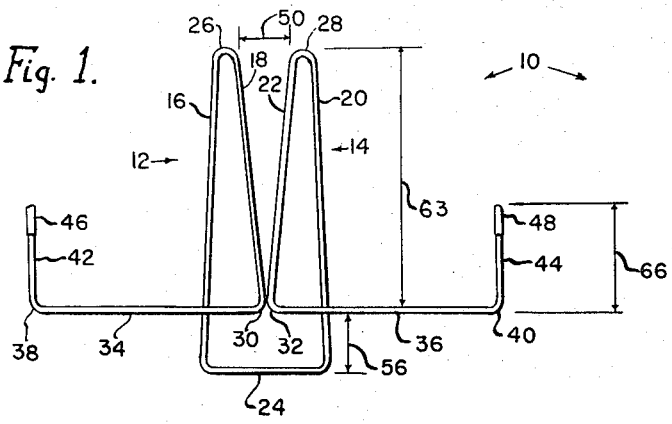
Fig. 2.
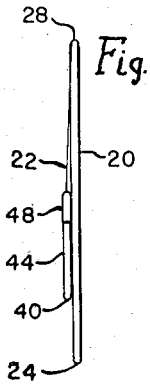
Fig. 3.
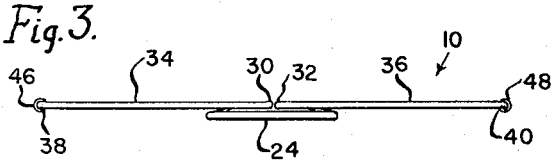
Fig. 4.
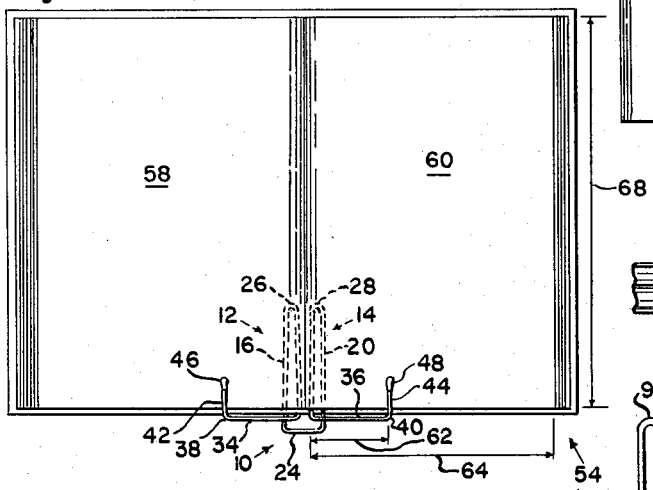
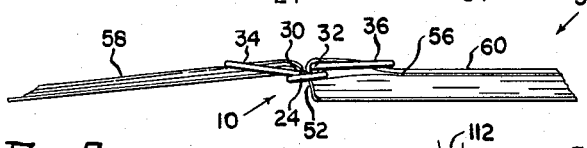
Fig. 5.
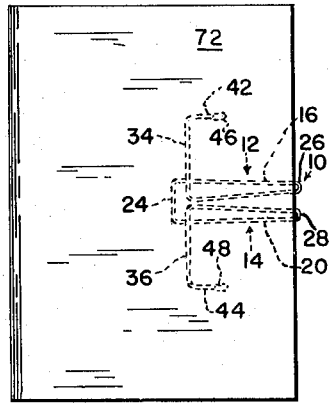
Fig. 6.
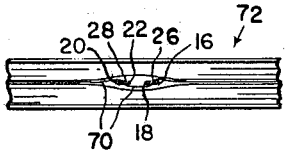
Fig. 7.
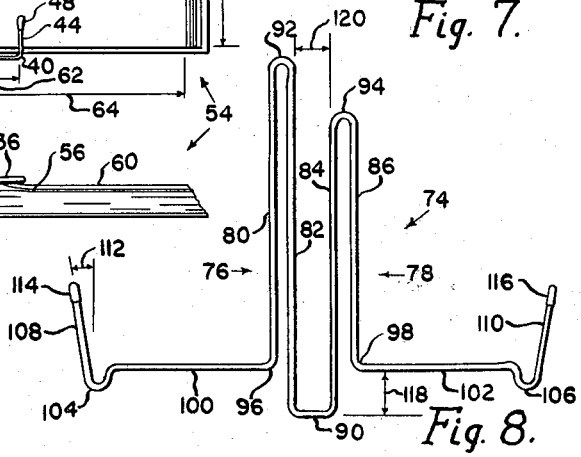
Fig. 8.

COMBINED BOOK LEAF HOLDER AND BOOKMARK

TECHNICAL FIELD

A pocket portable combined book leaf holder and bookmark device suitable for holding both paper back and hard cover books in open position at a page of immediate interest without obstructing printed material on the page, or alternatively to mark for easy access the page of interest for subsequent reference.

Usually it requires the use of both hands to keep a book open to a page of immediate interest such as when reading. However, freeing of one or both hands from this tedious chore not only tends to increase one's reading enjoyment, but also makes possible the performance of other manual duties such as taking notes while reading or otherwise referring to a page in the book. An added advantage of the present invention is that the same device may be readily used to mark one's place in the book for easy access to the desired page at a subsequent time.

BACKGROUND ART

Prior art devices for holding a book open are generally of such a large size and configuration that they are impractical for carrying in one's pocket for subsequent use. Examples of such devices appear in U.S. Pat. Nos. 1,196,715; 2,276,897 and 3,661,405.

Physically smaller prior art devices generally hold only the leaves on one side of the spine of a book and thus require two separate devices, one on each side of the spine of the book for keeping the desired pages in open position. They also require anchoring the device to the hard cover of the book and thus are difficult to use with paper back books. Examples of such devices appear in U.S. Pat. Nos. 1,150,678; 1,646,291 and 1,710,949.

DISCLOSURE OF INVENTION

The present invention achieves a relatively simple and inexpensive combined book leaf holder and bookmark which is not only small enough and of a shape which lends itself to be carried conveniently in one's pocket for subsequent use on books with few or many pages, but also holds the book open by engaging the pages of immediate interest on both sides of the spine of the book in manner to hold the book open to those pages without the assistance of one's hands while still permitting easy manual turning of pages of the book.

Additionally, the engagement with the pages is at the page margins so that the present invention does not obstruct visibility of the printed matter on the pages of interest which are being held in open position.

Further, the present invention is applicable for holding both hard cover and paper back books in open position to the pages of interest and is also applicable for use as a bookmark to provide ready identification of and ready access to a page of interest.

These features of the present invention of a combined book leaf holder and bookmark are achieved generally by the provision of a substantially parallel pair of prongs emanating from a common juncture and separated an effective distance such that one of the prongs is insertable behind the spine of the book and the other prong is insertable between the leaves of the book several pages beyond the pages of immediate interest, each of the prongs having a resilient arm adjacent the common juncture and extending outwardly at substantially right angles to the prongs, the respective arms being in substantially a single plane with the prongs and extending in opposite directions to each other, and each of the arms having a page engaging finger transverse to the respective arm and an effective distance from the associated prong for engaging the pages of immediate interest and in cooperation with the prongs and arms holding the book open at the pages of immediate interest.

The prongs, arms and fingers are preferably of resilient metal wire with each of the prongs being comprised of two legs of the wire with one of the legs emanating from the common juncture and the other of the legs emanating from a reverse bend at the extremity of the prong opposite the common juncture.

The common juncture of the prongs is positioned a sufficient distance from the arms to provide a finger grip for facilitating manipulation of the invention with respect to the book.

By forming the other leg of each of the prongs so that it is inwardly of the one leg and carries the associated arm of each of the prongs, and with the junctures of the respective arms and legs close to each other thereby provides a structure for firmly engaging the spine of the book to facilitate retaining its position in operation.

By alternatively forming the other leg of each of the prongs so that it is outwardly of the one leg and carries the associated outwardly extending arm of the prong thereby provides a single plane structure which simplifies manufacture.

By making one of the prongs longer than the other tends to facilitate the insertion of the invention in its proper position for holding the book in open position.

Providing a projection at the juncture of each of the arms and its respective page engaging finger facilitates manual lifting of the finger for turning of the page of the book.

BRIEF DESCRIPTION OF DRAWINGS

The above mentioned features and advantages will be better understood from the following description taken in connection with the accompanying drawings wherein:

FIG. 1 is a plan view of a preferred embodiment of a combined book leaf holder and bookmark in accordance with the present invention;

FIG. 2 is a side view of the FIG. 1 embodiment;

FIG. 3 is an end view of the FIG. 1 embodiment;

FIG. 4 is a plan view of a book held in open position at pages of immediate interest by the FIG. 1 embodiment;

FIG. 5 is an end view of the FIG. 4 illustration;

FIG. 6 is a plan view of a book in closed position with the FIG. 1 embodiment of the present invention shown in position therein by broken lines to function as a bookmark;

FIG. 7 is a front view of a portion of the FIG. 6 illustration to more clearly show the bookmark function of the FIG. 1 embodiment of the invention;

FIG. 8 is a plan view of a second embodiment of a combined book leaf holder and bookmark in accordance with the present invention.

BEST MODE FOR CARRYING OUT THE INVENTION

Referring to the drawings in more detail, a preferred embodiment of a combined book leaf holder and bookmark in accordance with the present invention is designated generally by the numeral 10. The combined book leaf holder and bookmark 10 has a pair of substantially parallel prongs 12 and 14, each formed by a pair of resilient metal wire legs 16, 18 and 20,22 respectively. The wire legs 16 and 20 emanate from a common juncture 24, and the wire legs 18 and 22 emanate from reverse bends 26 and 28 at the respective apexes or extremities of the associated prongs 12 and 14 opposite the common juncture 24.

The legs 18 and 22 lie inwardly of and between the legs 16 and 20 and near the common juncture 24 in or near touching relation to each other and have bends 30 and 32 to form arms 34 and 36 extending outwardly in opposite directions to each other at substantially right angles to the prongs 12 and 14. The arms 34 and 36 at their outside extremities have bends 38 and 40 respectively extending at substantially right angles to the arms 34 and 36 and substantially parallel to the prongs 12 and 14 to form page holding fingers 42 and 44 respectively. The fingers 42 and 44 preferably have plastic or rubber coatings 46 and 48 respectively at their ends to cover sharp metal edges and for improved contact with book pages as will be hereinafter further explained. The arms 34 and 36 are preferably touching or nearly touching the legs 16 and 20 so as to be with the fingers 42 and 46 in substantially the same plane as that of the prongs 12 and 14.

The legs 18 and 22 at the extremities 26 and 28 respectively are separated from each other a sufficient distance 50 to insure easy insertion of one of the prongs such as 12 behind the spine and fabric or paper covering 52 of a book 54 (FIG. 5) and the other prong 14 between the leaves of the book 54 several pages 56 beyond the pages 58 and 60 of immediate interest. By way of example and not limitation, a distance 50 of about three eights of an inch has been found to be satisfactory for use with most books.

The legs 16 and 20 preferably extend beyond the arms 34 and 36 to the common juncture 24 a distance 56 sufficient to provide a suitable grip between the fore finger and thumb of one's hand for facilitating a manual hold for insertion of the prongs 12 and 14 into position for holding the book 54 in open position as shown in FIGS. 4 and 5. For this purpose the prong 12 is inserted beneath the spine and its fabric or paper covering 52 and the prong 14 is inserted several book leaves 56 beyond the pages 58 and 60 of immediate interest. As the prongs 12 and 14 are progressively pushed into place, care is taken to insure that the finger 42 rests on the page of immediate interest 58 and the finger 44 rests on the page of immediate interest 60. The resilience of the wire in the fingers 42 and 44, the arms 34 and 36, and legs 16, 18 and 20, 22 of the book leaf holder 10 accomodates itself to the particular place in the book 54 to effectively hold the book 54 in open position as shown in FIGS. 4 and 5, as well as holding the book leaf holder 10 firmly in place in the book 54 so that it does not fall away even when the book is moved about at any angle. To that end, it will be noted that legs 18 and 22 tend to deflect so that their ends at the bends 30 and 32 respectively are firmly against both sides of the spine 52 and the plastic or rubber coatings 46 and 48 on the ends of the fingers 42 and 44 engage the page surfaces to frictionally as well as pressurably assist in holding the book leaf holder in place. By way of example and not limitation, I have found that a length 62 of each of the arms 36 and 34 equal to about one third the width 64 of a page of the book 54, and prongs extending a distance 63 of about one fourth the length 68 of the page are suitable dimensions for proper operation of the invention for holding most books in open position at pages of immediate interest. Also, a length 66 (FIG. 1) of each of the fingers 42 and 44 equal to about one tenth the length 68 (FIG. 4) of the pages of a book such as 54 is sufficient to properly maintain the book 54 in open position to the pages of immediate interest. Thus, the fingers 42 and 44 will generally be sufficiently short to be limited to the margins of the book pages and will thus not obstruct visibility of printed material on the book pages such as 58 and 60.

When it is desired to turn a page, such as from page 60 to the succeeding page, the page may generally be slid diagonally from under the coated finger end 48 and in reverse manner slid into position under the other coated finger end 46 of the finger 42. Alternatively the finger 44 may be raised by manual pressure upward at the bend 40 whereby the page 60 is completely released for transfer onto page 58 and inserted under the finger 42 which may have been similarly raised from contact with page 58 by manual pressure upward at the bend 38.

The book leaf holder 10 may be removed at any desired time from a book such as the book 54 preferably by grasping the common juncture 24 and pulling in a direction parallel to the length of the book.

To use the combined book leaf holder and bookmark 10 as a bookmark requires only the insertion of the desired book leaf 70 or several consecutive book leaves between the legs 16,20 and the legs 18,22 at a position preferably centrally of the length of the page and with the forward edge of the book leaf 70 being at the extremities or apexes 26 and 28 of the prongs 12 and 14 so that the bookmark 10 will be carried between the book leaves completely within the closed book 72 as shown by broken lines in FIG. 6 and in exagerated form in FIG. 7.

A second embodiment of the combined book leaf holder and bookmark in accordance with the present invention is designated generally by the numeral 74 in FIG. 8. The combined book leaf holder and bookmark 74 has a pair of substantially parallel prongs 76 and 78, each of which is formed by a pair of resilient wire legs 80,82 and 84,86 respectively. The legs 82 and 84 emanate from a common juncture 90 and the legs 80 and 86 emanate from a reverse bend 92 and 94 respectively at the extremities or apexes of the legs 82 and 84 opposite the common juncture 90 and forming the apexes or extremities of the prongs 76 and 78 respectively. The prong 78 is shorter than the prong 76 for reasons to be hereinafter described.

Legs 80 and 86 lie outwardly of the legs 82 and 84 and near the common juncture 90 have bends 96 and 98 respectively to form arms 100 and 102 extending in opposite directions from each other at substantially right angles to the prongs 76 and 78. The arms 100 and 102 at their outside extremities have reverse bends 104 and 106 which terminate in page holding fingers 108 and 110 respectively extending outwardly in transverse relation to the arms 100 and 102 at an angle 112 about ten degrees beyond a right angle. The page holding fingers have plastic or rubber covered ends 114 and 116 respectively which may be similar to the end coatings 46 and 48 in the FIG. 1 embodiment.

The common juncture 90 preferably extends a distance 118 beyond the arms 100 and 102 sufficient to grasp the common juncture 90 between one's forefinger and thumb for facilitating insertion of the prongs 76 and 78 in the end of a book such as 54 in manner explained above with respect to the FIG. 1 embodiment. To this end the distance 120 between the prongs 76 and 78 is preferably smaller than distance 50 in the FIG. 1 embodiment. By way of example and not limitation a distance 120 of about one quarter inch has been found suitable for most books.

In the operation of the combined book leaf holder and bookmark 74 as a book leaf holder, the common juncture 90 is grasped preferably between one's forefinger and thumb and the extended portion of the longer prong 76 is steadied against the spine and its covering fabric or paper 52 to facilitate the insertion of the shorter prong 78 between the leaves several pages, such as 56, beyond the pages such as 58 and 60 of immediate interest. Whereupon both prongs are slid into place with the fingers 108 and 110 engaging the pages of immediate interest 58 and 60, in which position the FIG. 8 embodiment will hold the book, such as 54, in open position at the pages 58 and 60.

Alternatively the extension of the longer prong 76 may first be inserted between the leaves several pages such as 56 beyond the pages of immediate interest 58 and 60, in which case the shorter prong 76 will be inserted behind the spine and covering fabric or paper, such as 52, and the fingers 108 and 110 engaging the pages of interest 60 and 58 respectively to thereby hold the book in open position.

The page holding fingers 108 and 110 being at the angle 112 tends to fit the surface contour of the respective pages such as 58 and 60 when the book 54 is held in open position and tends to facilitate turning of pages such as sliding page 60 from under the finger 110 and inserting by sliding it under the finger 108. Such page turning is further facilitated by the projections formed by reverse bends 104 and 106 which provide convenient places to apply manual upward pressure to lift the respective fingers 108 and 110 to free the respective pages.

It should be noted that one or more of the features of the FIG. 8 embodiment, such as difference in length of the prongs 76 and 78, reverse bend projections 104 and 106 for facilitating lifting of the fingers, and angle 112 of the fingers 108 and 110 are applicable for incorporation in the FIG. 1 embodiment as desired.

What is claimed is:

1. A combined book leaf holder and bookmark for a conventional book of the type having a book spine holding a plurality of book leaves having like width and like length dimensions and forming pages of the book, comprising, a. a pair of substantially parallel prongs emanating from a common juncture and separated from each other, b. each of said prongs comprising two legs with one of said legs emanating from said common juncture and the other of said legs emanating from a reverse bend at the extremity of said prong opposite from said common juncture, c. each of said other legs having a resilient arm adjacent the common juncture and extending outwardly at substantially right angles to said prongs, the respective arms being in a substantially single plane with the prongs and extending in opposite directions to each other, d. each of said arms having a page engaging finger in said substantially single plane and transverse to the respective arm, and e. each of said other legs extending inwardly of its one leg such that said other legs are in close proximity to each other at the juncture of said other legs and said arms.

2. A combined book leaf holder and bookmark as in claim 1 wherein said common juncture extends beyond said arms on the side of said arms opposite said prong extremities to provide a finger grip for facilitating manipulation of said combined book leaf holder and bookmark with respect to said book.

3. A combined book leaf holder and bookmark as in claim 1 wherein said page engaging finger of each of said arms is substantially shorter than said prongs.

4. A combined book leaf holder and bookmark for a conventional book of the type having a book spine holding a plurality of book leaves having like width and like length dimensions and forming pages of the book, comprising, a. a pair of substantially parallel prongs emanating from a common juncture and separated from each other, b. each of said prongs comprising two legs with one of said legs emanating from said common juncture and the other of said legs emanating from a reverse bend at the extremity of said prong opposite from said common juncture, c. each of said other legs having a resilient arm adjacent the common juncture and extending outwardly at substantially right angles to said prongs, the respective arms being in a single plane with the prongs and extending in opposite directions to each other, and d. each of said arms having a page engaging finger in said single plane and transverse to the respective arm, and at an effective distance from the associated prong for engaging the pages of immediate interest in manner to cooperate with said prongs and arms to hold said book open at said pages of immediate interest.

5. A combined book leaf holder and bookmark as in claims 1 or 4 wherein one of said prongs is longer than the other of said prongs.

6. A combined book leaf holder and bookmark as in claims 1 or 4 wherein each of said arms has a reverse bend at the position of its associated page engaging finger for facilitating manual lifting of the finger from engagement with the page.

7. A combined book leaf holder and bookmark as in claims 1 or 4 wherein said combined book leaf holder and bookmark is comprised of a single length of metal wire.

8. A combined book leaf holder and bookmark as in claim 4 wherein said common juncture extends beyond said arms on the side of said arms opposite said prong extremities to provide a finger grip for facilitating manipulation of said combined book leaf holder and bookmark with respect to said book.

9. A combined book leaf holder and bookmark as in claim 4 wherein said page engaging finger of each of said arms is substantially shorter than said prongs.

* * * * *